United States Patent [19]

Hayashi

[11] Patent Number: 4,952,920

[45] Date of Patent: Aug. 28, 1990

[54] DISPLAY APPARATUS HAVING HORIZONTAL/VERTICAL CONVERSION DISPLAY FUNCTIONS

[75] Inventor: Yasushi Hayashi, Kawasaki, Japan

[73] Assignee: Kabushiki Kaisha Toshiba, Kawasaki, Japan

[21] Appl. No.: 146,042

[22] Filed: Jan. 20, 1988

[30] Foreign Application Priority Data

Jan. 20, 1987 [JP] Japan ..... 62-10331

[51] Int. Cl.[5] ..... G09G 5/40

[52] U.S. Cl. ..... 340/727; 340/723; 340/721

[58] Field of Search ..... 340/727, 723, 724, 721; 358/140, 287

[56] References Cited

U.S. PATENT DOCUMENTS 4,267,555 5/1981 Boyd et al. ..... 340/727
4,520,399 5/1985 Iida .
4,542,377 9/1985 Hagen et al. ..... 340/727
4,554,638 11/1985 Iida .
4,593,407 6/1986 Konishi et al. ..... 340/727
4,741,635 5/1988 Shibato et al. ..... 340/727

*Primary Examiner*—Jeffery A. Brier
*Attorney, Agent, or Firm*—Cushman, Darby & Cushman

[57] ABSTRACT

In a document file apparatus, image data to be displayed on a CRT display unit of a vertical scanning type having a rectangular display area whose long sides are aligned with a horizontal direction is temporarily stored in a page memory. An enlarge/reduction circuit changes a character font generated by a character generator into a pattern of a predetermined size. The address of the converted character font is translated by a rotation buffer, and the character data is substantially rotated 90°, clockwise on the display screen. The 90°-rotated data is temporarily stored in a display memory so as to correspond to the image data supplied from the display memory. An image corresponding to the stored image data is displayed on a CRT display unit. The image displayed on the CRT display screen is erected with respect to the normal viewing position of the operator.

13 Claims, 3 Drawing Sheets

DISPLAY APPARATUS HAVING HORIZONTAL/VERTICAL CONVERSION DISPLAY FUNCTIONS

BACKGROUND OF THE INVENTION

This invention relates to a display apparatus having a lateral display area, and more particularly, to a display apparatus having a display unit capable of displaying a horizontally and vertically long image constituted by graphic and character patterns.

Image data such as document and drawing data used in a large amount are generally processed and filed by a document file apparatus. The image data is read from an original by a two-dimensional scanning device and is stored in, e:g, an optical disk. The image data is arbitrarily retrieved and read out from the optical disk. Such a document file apparatus is very popular. In this apparatus, the image data read by the two-dimensional scanning device or read out from the optical disk is displayed on a CRT (cathode-ray tube) display unit as a display apparatus. Such CRT display units used are classified into vertical (i.e., the dimension along the vertical direction is larger than that along the horizontal direction) and horizontal (i.e., the dimension the along horizontal direction is larger than that along the vertical direction) type CRT display units.

A conventional document file apparatus uses a vertical or lateral CRT display unit, but applications (i.e., rows×columns) of characters displayed on the vertical and horizontal type display units differ from each other. For this reason, even if the circuit components of the document file apparatus for the vertical and horizontal type display units are identical, different applications for the vertical and horizontal type display units must be developed. Since different character application programs are developed for the vertical and horizontal display units in document file apparatus including identical components except for the display units, the high cost and long time are undesirably required to develop application software for the vertical and horizontal character applications.

SUMMARY OF THE INVENTION

Accordingly, it is the object of the present invention to provide a display apparatus having a lateral display area, wherein the cost and time which are required for developing the character applications for the vertical and horizontal type display units in display apparatus having identical components excluding the display units can be greatly reduced and shortened. Thus the application development can be achieved within a short period of time.

According to the present invention, there is provided display apparatus having a character horizontal/vertical conversion display functions, comprising means for displaying data on a horizontal display area, the display means having a plurality of vertical scanning lines, means for generating a character pattern data to be displayed on the displaying means, means for converting the character pattern data from the generating means into substantially 90° rotated character pattern data with respect to the vertical scanning lines, and means for supplying the converted character pattern data to the display means.

According to another aspect of the present invention, there is provided a display apparatus having, a character horizontal/vertical conversion display functions, comprising first memory means for temporarily storing image data, display means for displaying the image data stored in the first memory means on a horizontal display area, the display means having a plurality of vertical scanning lines, means for generating a plurality of character pattern data to be displayed on the display means, means for converting the character pattern data from the generating means into substantially 90° rotated character pattern data with respect to the vertical scanning lines, second memory means for temporarily storing the converted character pattern data supplied from the converting means and also the image data stored in the first memory means, and means for supplying the image data and the converted character pattern data in the second memory means to the display means.

According to still another aspect of the present invention, there is provided a display apparatus having character horizontal/vertical conversion display functions, comprising first memory means for temporarily storing image data; displaying means for displaying the image data stored in the first memory means on a horizontal display area, the display means having a plurality of vertical scanning lines; means for generating a plurality of first character pattern data to be displayed on the display means; means for generating a first control signal when the display means is vertically long, and a second control signal when the display means is horizontally long; means for generating second character pattern data when the first control signal is generated; and third character pattern data when the second control signal is generated, means for converting substantially the second character pattern data, when received from said second character pattern data generating means, 90° with respect to the vertical scanning lines of the display means so that the second character pattern data corresponds to the image data temporarily stored in the first memory means, thereafter displaying the converted second character pattern data on the display means, outputting the converted second character pattern data when data output from the second character pattern data generating means is the second character pattern data, and for outputting the third character pattern data without rotation when output from the third character pattern data generating means; second memory means for temporarily storing the second character pattern data after being converted by the predetermined conversion, or the third character pattern data output from the converting means, the second or third character pattern data being stored and also the image data stored in the first memory means; and means for supplying the image data and the second or third character pattern data in the second memory means to the display means.

BRIEF DESCRIPTION OF THE DRAWINGS

These and other features of the present invention will become more apparent from the following detailed description of exemplary embodiment thereof, as illustrated in the accompanying drawings, in which.

DETAILED DESCRIPTION OF THE PREFERRED EMBODIMENT

An embodiment of the present invention will now be described with reference to the Figures.

Figure 1:
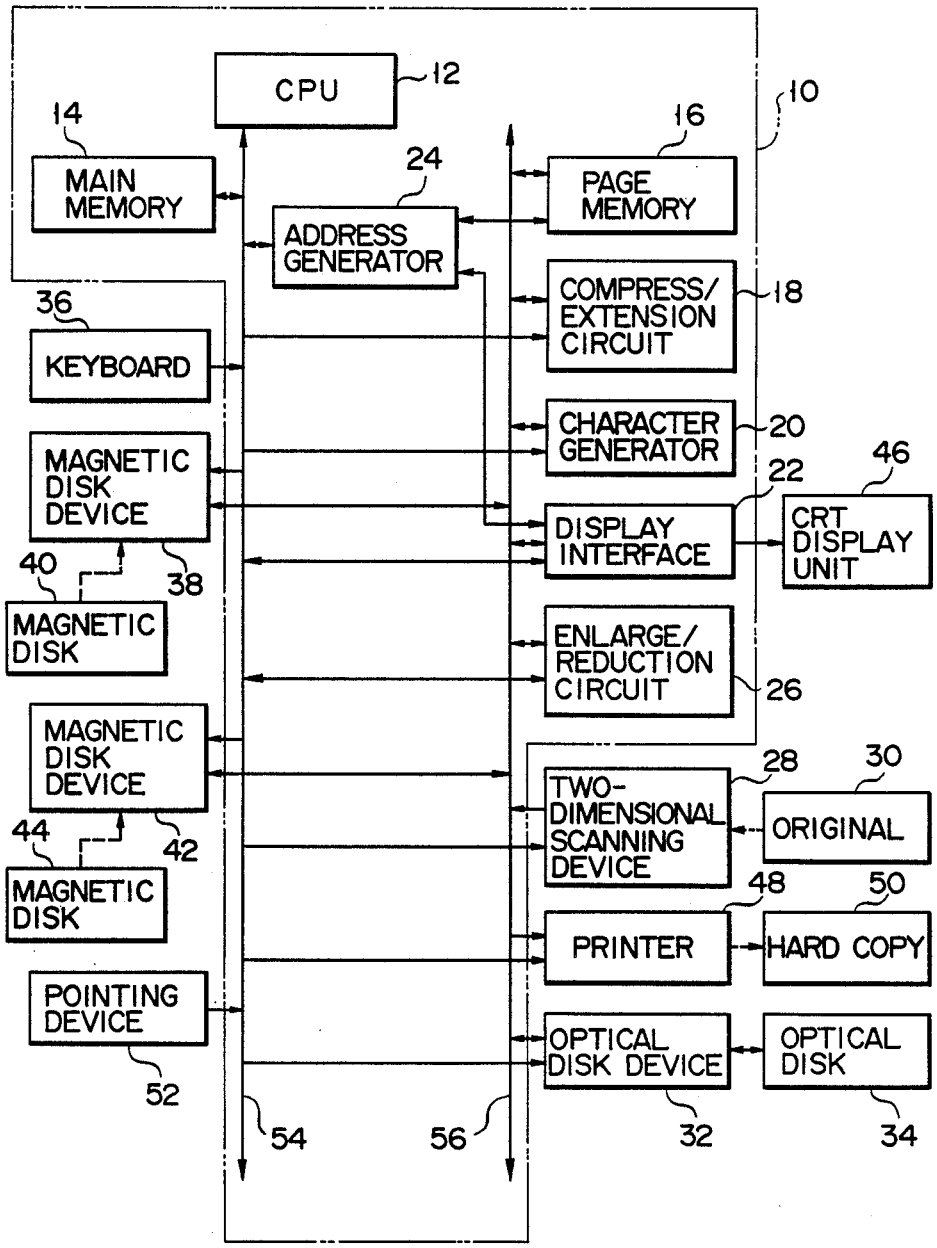
FIG. 1 is a schematic block diagram showing the overall arrangement of a document file apparatus employing a display apparatus according to the present invention.

FIG. 1 shows a document file apparatus employing a display apparatus of the present invention. Main controller 10 includes CPU 12 for performing various control operations, main memory 14, page memory 16 which has a memory capacity corresponding to a few A1-sized original pages of image data (memory data), compress/extension circuit 18 for compressing or expanding the image data, character generator 20 for storing pattern data representing characters, symbols, and the like, display interface 22, address generator 24, and enlarge/reduction circuit 26 for enlarging or reducing the image data.

CPU 12 outputs an aspect control signal to display interface 22 and enlarge/reduction circuit 26 upon detecting that the screen of CRT display unit 46 (to be described later) is of a vertical type (i.e., the dimension in the vertical direction is larger than that in the horizontal direction) or a horizontal type (i.e., the dimension in the horizontal direction is larger than that in the vertical direction). The selection of a vertical or horizontal type of CRT display unit 46 is preset by a dip switch or the like.

Character generator 20 stores character fonts of alphanumeric character and symbolic patterns each of a 24 pixels×24 pixels size.

CPU 12 outputs an aspect control signal representing the vertical or horizontal type display unit. This control signal is supplied to character generator 20. In accordance with the control signal, enlarge/reduction circuit 26 enlarges or reduces the character font data supplied from character generator 20 at the changed ratio. The enlarged or reduced font data, which represents an enlarged or reduced character pattern, is input to CRT display unit 46. For example, when the screen of unit 46 is of a vertical type, the character pattern is enlarged to a size of 40 pixels×40 pixels. When the screen is of a horizontal type, the character pattern is enlarged to a size of 32 pixels×32 pixels.

Two-dimensional scanning device 28 serving as a reading means (scanner) scans original 30, in a two-dimensional manner, with laser beam light to obtain an electrical signal corresponding to the image data on original 30. Optical disk device 32 causes optical disk (memory means) 34 to sequentially store image data read out by two-dimensional scanning device 28 and supplied via main controller 10.

Keyboard 36 is for inputting a retrieval code or the like corresponding to each image data. Magnetic disk device 38 uses magnetic disk 40 for storing the retrieval code input at keyboard 36, and retrieval data constituted by an image data size corresponding to this retrieval code and a memory address of optical disk 34 for storing the image data in units. Magnetic disk device 38 comprises a hard disk device. Magnetic disk device 42 is loaded with magnetic disk 44 processed by a personal computer, a wordprocessor, or the like and can be, e.g., a floppy disk device.

CRT display unit 46, serving as an output device such as a display means, displays image data read by two-dimensional scanning device 28 or optical disk device 32. CRT display unit 46 constitutes a single image data display device together with display interface 22 of main controller 10. Printer 48 prints out image data read by two-dimensional scanning device 28 from original 30, or image data read out by optical disk device 32 from optical disk 34. Printer 48 produces hard copy 50.

Pointing device 52 includes a mouse or a tablet. The mouse is used to shift, e.g., a cursor on CRT display unit 46 in the upper, lower, right, or left directions. When a command is input at a desired position, display contents (e.g., various modes, an editing image, an extraction range, and icons) represented by the desired position can be selected. The tablet is used to select the same display contents (e.g., various modes, an editing image, an extraction range, and icons) as those of CRT display unit 46.

The above system components are coupled to CPU 12 via system bus 54. Similarly, page memory 16, compress/extension circuit 18, character generator 20, display interface 22, enlarge/reduction circuit 26, two-dimensional scanning device 28, optical disk device 32, magnetic disk devices 38 and 42, and printer 48 are also coupled to CPU 12 via image bus 56.

The retrieval data constitutes a retrieval code (image name) of a plurality of retrieval keys, an image storage start track address in optical disk 34 at a position corresponding to this retrieval code, a corresponding image storage start sector address, and an image memory sector count (i.e, an image length).

Figure 2:
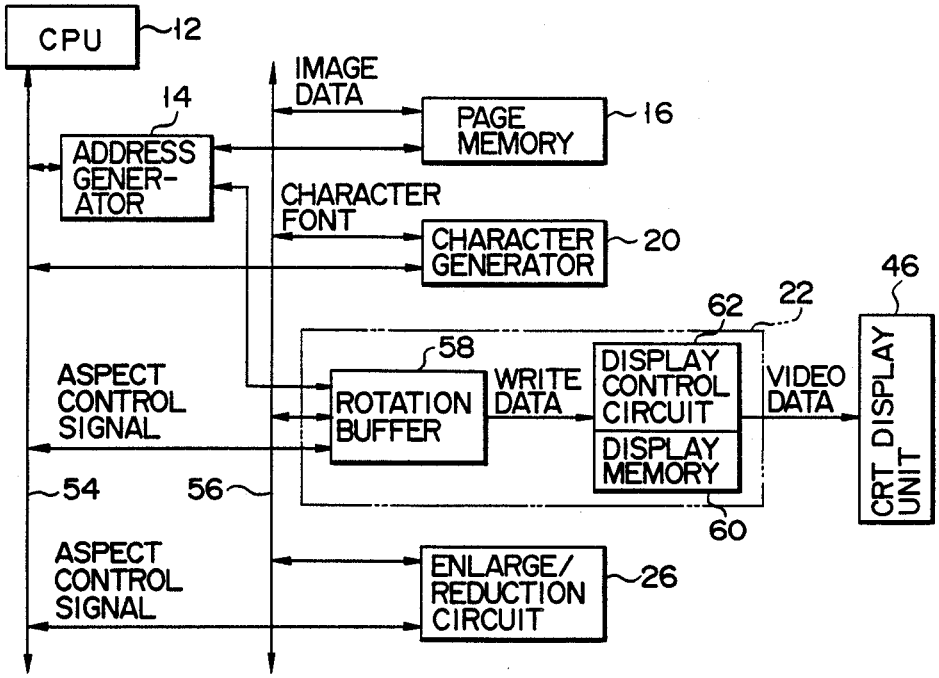
FIG. 2 is a block diagram showing a display interface in the apparatus shown in FIG. 1 and its peripheral portion.

Display interface 22 comprises rotation buffer 58 and display control circuit 62 having display memory 60, as shown in FIG. 2. Rotation buffer 58 performs orthogonal transformation (i.e., horizontal/vertical conversion) of the input data (Japanese patent application No. 55-153272). Rotation buffer 58 rotates the image data supplied from page memory 16 through 90°, or does not process the image data when not necessary and outputs the processed or non-processed data to display control circuit 62. Similarly, rotation buffer 58 rotates a character pattern from character generator 20 through 90°, or does not process it, and outputs the processed or non-processed data to display control circuit 62.

Figure 3:
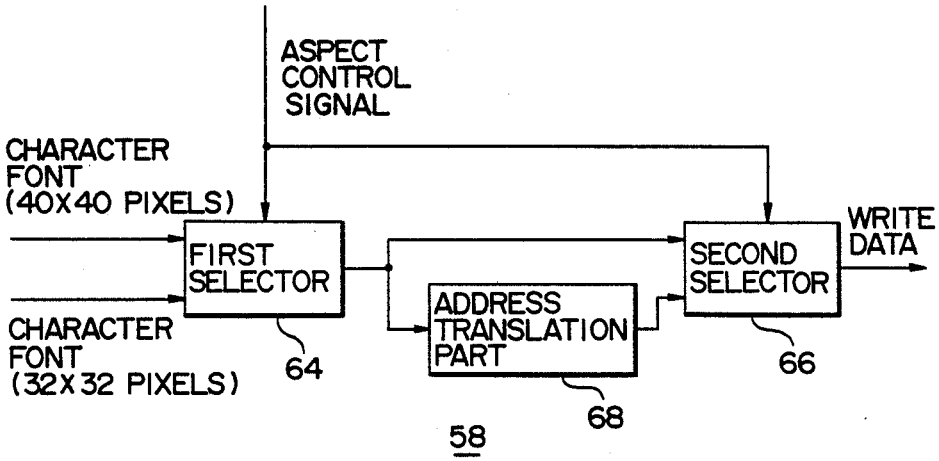
FIG. 3 is a view showing a detailed arrangement of a rotation buffer.
Figure 4:
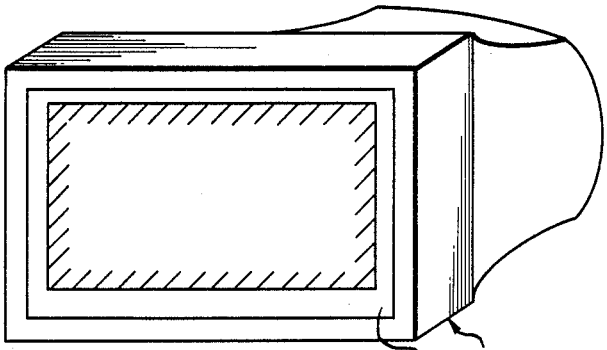
FIG. 4 is a view showing an outer appearance of a CRT display unit in FIG. 1.

FIG. 3 shows an arrangement of character generator 20 and rotation buffer 58. A vertical type screen character font of 40 pixels×40 pixels and a horizontal type screen character font of 32 pixels×32 pixels are input to first selector 64. Selector 64 selects the character font of 40 pixels×40 pixels or 32 pixels×32 pixels in accordance with the aspect control signal from CPU 12. An output from first selector 64 of character generator 20 is input to second selector 66 directly or through address translation part 68. Address translation part 68 is arranged to update the address such that the character font output from first selector 64 is rotated through 90° with respect to the character font input to first selector 64. Selection of the input to second selector 66 is controlled by the aspect control signal input from CPU 12 in the same manner as first selector 64.

When CRT display unit 46 is of a vertical type, the character pattern supplied from character generator 20 is displayed without being rotated. However, if CRT display unit 46 is of a horizontal type, the character pattern from character generator 20 is rotated through 90°, and the rotated pattern is displayed on the screen.

In this embodiment, CRT display unit 46 has horizontal type screen 70 having vertical scanning lines. Screen 70 can be effectively used to display high-quality images. For example, a display density in the horizontal direction is given by 7.7 pixels/mm and a display density in the vertical direction is given by 8 pixels/mm. The number of scanning lines is about 2,400. The tube surface (i.e., screen 70) of CRT display unit 46 has a size of 311.7 mm in the horizontal direction and 224 mm in the vertical direction.

The operation of the document file apparatus having the above arrangement will be described below. In order to set the image data registration (storage) mode, a registration mode is set using keyboard 36, and a retrieval code for image data to be registered is input at keyboard 36. CPU 12 checks (cyclic redundancy check, CRC) the validity of input data in accordance with the defined retrieval code format using the number of digits and the types of character. CPU 12 checks the retrieval codes which have already been registered so as to prevent double registration. After these check operations, if the input retrieval code is found to be a correct retrieval code, the input code is stored in main memory 14.

The operator inputs a size of original 30 into the apparatus and sets original 30 on two-dimensional scanning device 28. Two-dimensional scanning device 28 two-dimensionally scans image data on the set document and photoelectrically converts the scanned image into electrical signals. The photoelectrically converted line data are sequentially stored in page memory 16. In this case, the memory area in page memory 16 corresponds to the size of the original.

When one-page image data is stored in page memory 16, the image data is gated through rotation buffer 58 in display interface 22 and is output to display memory 60 in display control circuit 62. The image data stored in display memory 60 is displayed on screen 70 in CRT display unit 46.

If the image displayed on CRT display unit 46 is perfect without misregistration or omissions, a recording key (not shown) is operated. CPU 12 causes compress/extension circuit 18 to perform known MH (Modified Huffman) conversion of the one-page image data stored in page memory 16. The band of the data is compressed in units of line data. The compressed line data is supplied to optical disk device 32. Optical disk device 32 causes optical disk 34 to store image data.

When this image data is completely stored in optical disk 34, CPU 12 stores a memory address (e.g, a track number, a start sector, and an image length) at which the image data is stored. The memory address corresponds to the retrieval code. CPU 12 supplies the retrieval data (i.e., a retrieval code, a track number, and an image length) stored in main memory 14 to magnetic disk device 38. Magnetic disk device 38 causes magnetic disk 40 to store the supplied retrieval data. Other image data can also be stored in optical disk 3 in the same manner as described above.

Characters to be displayed on the CRT display unit in its image data display state will be described below.

A character input mode is set at keyboard 36, and character data is input. Character data input at keyboard 36 is displayed on screen 70 of CRT display unit 46. More specifically, each character is read out from character generator 20, and its character font has a density of 24 pixels×24 pixels. The character font of 24 pixels×24 pixels is changed into a character font having a predetermined size by character generator 20. Since CRT display unit 46 is of a horizontal type, the character font is converted into a character font of 32 pixels×32 pixels by character generator 20, and is input from character generator 20 to first selector 64. The horizontal type font of 32 pixels×32 pixels is selected in response to the aspect control signal from CPU 12. The converted data is sent to rotation buffer 58 in display interface 22.

Second selector 66 determines whether the font selected by the first selector is output without rotation or is rotated through 90°. In this case, since the character font has a density of 32 pixels×32 pixels, the font must be rotated through 90° and the rotated font must be output. In response to the aspect control signal, second selector 66 selects the character font obtained through address translation part 68 and outputs the resultant font. 90° rotation or non-rotation is selectively performed due to the following reason.

Figure 5:
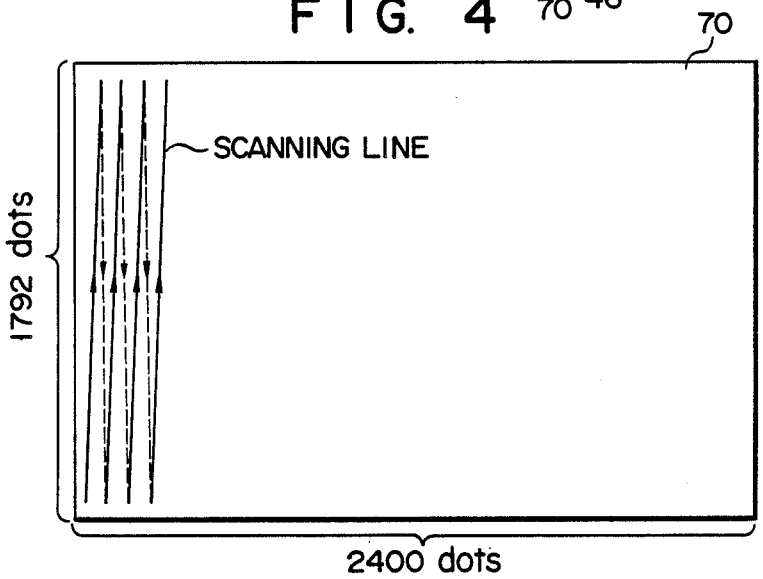
FIG. 5 is a schematic view showing a scanning state of the electronic beam in the CRT display unit of FIG. 1.

When CRT display unit 46 is of a horizontal type, the CRT display unit is used such that the image to be displayed on it is rotated through 90° counterclockwise. For this reason, a scanning line directed from the left to the right of the screen is converted into a scanning line directed from the lower direction to the upper direction in horizontal type CRT display unit 46, as shown in FIG. 5. In this state, however, a character displayed on screen 70 is rotated through 90° counterclockwise with respect to the normal viewing position of the operator. In addition, a character displayed at the upper left corner of the vertical type screen is displayed at the lower left corner in the horizontal type screen. Therefore, the character displayed on horizontal type screen 70 must be rotated to be an erected state with respect to the normal viewing position of the operator.

Horizontal type CRT display unit 46 is obtained by rotating a vertical type CRT unit through 90° counterclockwise, as described above. Therefore, characters to be displayed on such horizontal type display unit 46 are also rotated through 90° counterclockwise if no special processing is performed. In order to display the character in an erected state, the character is rotated clockwise through 90°. In addition, a character located at a position (e.g., the upper left corner) to be displayed on the vertical type screen is displayed at the corresponding position (the upper left corner) on the horizontal type screen. When the horizontal type CRT display unit is used, a predetermined character font from the first selector is input to address translation part 68. Address translation part 68 changes the character font address so as to rotate the input character font through 90° clockwise and to display the character on horizontal screen 70 in correspondence with the image data supplied from page memory 16. The data supplied from address translation part 68 is displayed on screen 70 of horizontal type CRT display unit 46 in the erected state with respect to the normal viewing position of the operator.

When the vertical type CRT display unit serves as a reference display unit and the character font displayed on this screen has a density of 40 pixels×40 pixels so as to display the image in the erected state with respect to the normal viewing position of the operator, the image may be partially omitted along the vertical direction. This is because the CRT display unit has different dimensions in the vertical and horizontal directions as can be seen from the fact that the normal CRT display unit is of either vertical or horizontal type. In order to display the image on horizontal type CRT display unit 46, the size of the character font to be displayed must be changed. The size of the character font is determined by the number of pixels of the screen of CRT display unit 46 and is, e.g., 32 pixels×32 pixels. Therefore, a vertical type image constituted by the character font of 32 pixels×32 pixels is displayed on screen 70 of CRT display unit 46.

When horizontal type CRT display unit 46 is used, the character font of 32 pixels×32 pixels supplied from character generator 20 is selected by first selector 64 in response to the aspect control signal supplied from CPU 12. The character font of 32 pixels×32 pixels is rotated through 90° by address translation part 68 so as to display the font in the erected state with respect to the normal viewing position of the operator. At the same time, the address is translated so as to display the font at a position corresponding to the image data stored in the display memory 60. As described above, the image displayed on the vertical type CRT display unit is displayed without omission within screen 70 of lateral type CRT display unit 46. The size of the character font is reduced such that the image to be displayed falls within the area of horizontal type screen 70. In this case, blank spaces are formed at sides of horizontal type screen 70. Therefore, the image is displayed at the central portion on screen 70 of horizontal type CRT display unit 46. For example, the range which displays the image is given as a gray area, and the range which does not display the image is given as a white area.

Figure 6:
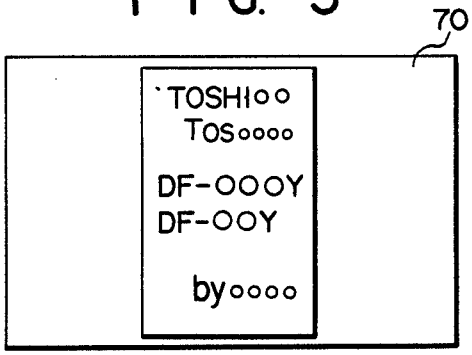
FIG. 6 is a view showing an image display state in the CRT display unit in FIG. 1.

The character font of 32 pixels×32 pixels which is rotated through 90° at a predetermined display position is selected by the second selector 66 in response to the aspect control signal. The image defined by the character font of 32 pixels×32 pixels and capable of being displayed on horizontal CRT display unit 46 is stored in display memory 60 in display control circuit 62 as write data. The image stored in display memory 60 is displayed on screen 70 of CRT display unit 46 through display control circuit 62. As shown in FIG. 6, a character is therefore displayed in the erected state with respect to the normal viewing position of the operator.

When a vertical type CRT display unit is used, a character font of 24 pixels×24 pixels is converted into a character font of 40 pixels×40 pixels by character generator 20. The character font of 40 pixels×40 pixels supplied from character generator 20 is selected by first selector 64 in response to the aspect control signal from CPU 12. The character font need not be rotated in the vertical type CRT display unit. The character font of 40 pixels×40 pixels selected by first selector 64 is directly supplied to second selector 66 without being processed by address translation part 68. The character font of 40 pixels×40 pixels is selected by second selector 66 in response to the aspect control signal from CPU 12 in the same manner as in first selector 64. The image data obtained by using the selected character font of 40 pixels×40 pixels is stored in display memory 60. Other arrangements and operations are the same as those in the lateral CRT display unit, and a detailed description thereof will be omitted.

The character font for the conventional vertical type CRT display unit, that is, the font of 40 pixels×40 pixels, is changed to the font of 32 pixels×32 pixels (90° rotation). A common character application program can be used for the vertical and horizontal type CRT display units. Furthermore, the image can fall within the small display area in the horizontal screen. The large quantity of valuable character application software can be used in the vertical display unit without modifications. Development time and cost of character application software for the horizontal display unit can be reduced, and the common operations can be performed for the vertical and horizontal display units, thus resulting in convenience.

In the above embodiment, the CRT display unit is exemplified as a vertical or horizontal display unit. However, the CRT display unit may be a rotatable vertical/horizontal display. In this case, the vertical or horizontal display mode of the CRT display unit may be set at the CRT display unit or the keyboard. When the display area of the screen is effectively utilized, an erected image can be derived from the horizontal and vertical type images in a single model. The common operations are performed for the vertical and horizontal modes, thus resulting in convenience.

In the above embodiment, character data is inserted in a graphic image displayed in the recording mode. However, the character data may be inserted in a retrieved image and displayed with it. Alternatively, character data may be input at the keyboard to create a document.

What is claimed is:

1. A display apparatus comprising:

first memory means for temporarily storing image data to be displayed;

means for displaying the image data on a horizontal display area, said display means having a fixed display screen including the horizontal display area and having a plurality of vertical scanning lines;

means for generating character pattern data to be displayed on said displaying means, said character pattern data including an upright character pattern data with respect to said horizontal display area and a 90-degree rotated character pattern data with respect to the upright character pattern data;

means for converting said 90-degree rotated character pattern data into 90-degree clockwise rotated upright character pattern data;

second memory means for temporarily storing the 90-degree clockwise rotated upright character pattern data and the image data stored in said first memory means; and means for supplying said 90-degree clockwise rotated upright character pattern data and image data to said display means, thereby displaying said 90-degree clockwise rotated upright character pattern data and image data in an upright fashion with respect to the horizontal display area.

2. An apparatus according to claim 1, wherein said display means displays image data together with said character pattern data.

3. An apparatus according to claim 1, wherein said converting means comprises a rotation buffer.

4. An apparatus according to claim 3, wherein said rotation buffer comprises a part for translating an address of said character pattern data, and substantially rotating said 90-degree rotated character pattern data by 90-degree to obtain 90-degree clockwise rotated upright character pattern data.

5. An apparatus according to claim 4, further comprising means for updating said character pattern data generated by said generating means, into a predetermined pattern size.

6. An apparatus according to claim 5, wherein said updating means comprises an enlargement/reduction circuit.

7. A display apparatus having horizontal/vertical conversion display functions, said apparatus comprising:

first memory means for temporarily storing image data;

means for displaying said image data stored in said first memory means on a horizontal display area, said display means having a plurality of vertical scanning lines;

means for generating a first control signal when said display means has a display area fixed to be vertically long, and a second control signal when said display area is horizontally long;

means for generating first and second character pattern data to be displayed on said display means, said first character pattern data being generated when the second control signal is generated, and said second character pattern data being generated when the first control signal is generated;

means for converting substantially said first character pattern data 90° with respect to said vertical scanning lines of said display means so that said first character pattern data corresponds to said image data temporarily stored in said first memory means and to display the converted first character pattern data on said display means, for outputting the converted first character pattern data when data output from said first and second character pattern data generating means is said first character pattern data, and for outputting said second character pattern data without rotation when the data output from said first and second character pattern data generating means is said second character pattern data;

second memory means for temporarily storing said first character pattern data, converted by said predetermined conversion, or said second character pattern data output from said converting means together with said image data stored in said first memory means; and means for supplying said image data and said first or second character pattern data in said second memory means to said display means.

8. An apparatus according to claim 7, wherein a pattern size of said first character pattern data is smaller than that of said second character pattern data.

9. An apparatus according to claim 8, wherein said converting means comprises a rotation buffer.

10. An apparatus according to claim 9, wherein said rotation buffer comprises:

first selector means for receiving said first character pattern data and said second character pattern data and selecting one of said first character pattern data and said second character pattern data in accordance with an aspect control signal;

character pattern translation means for performing a predetermined conversion to substantially rotate said first character pattern data 90° with respect to said vertical scanning lines of said display means and to display the 90°-rotated first character pattern data on said display means only when the data supplied from said first selector means is said first character pattern data; and second selector means for receiving said 90°-rotated first character pattern data from said character pattern translation means and said second character pattern data from said first selector means and selecting one of said 90°-rotated first character pattern data and said second character pattern data in accordance with said aspect control signal.

11. An apparatus according to claim 10, wherein said character pattern translation means comprises a part for translating an address of said first character pattern data and substantially rotating said first character pattern data 90° with respect to said scanning direction of said display means.

12. An apparatus according to claim 11, further comprising means for updating said character pattern data generated by said generating means into a predetermined pattern size.

13. An apparatus according to claim 12, wherein said first character pattern data has a pattern of 32 pixels×32 pixels, and said second character pattern data has a pattern of 40 pixels×40 pixels.

* * * * *